United States Patent [19]

Kisler

[11] Patent Number: 4,463,040

[45] Date of Patent: Jul. 31, 1984

[54] COATING-BEAD STABILIZATION APPARATUS

[75] Inventor: Semyon Kisler, West Newton, Mass.

[73] Assignee: Polaroid Corporation, Cambridge, Mass.

[21] Appl. No.: 454,143

[22] Filed: Dec. 29, 1982

[51] Int. Cl.[3] ..... B05D 1/00

[52] U.S. Cl. ..... 427/445; 427/57; 427/424; 118/663; 118/708; 118/410; 118/506; 248/559; 248/638

[58] Field of Search ..... 239/102; 101/366; 248/559, 638; 118/663, 410, 506, 708; 427/424, 445, 57

[56] References Cited

U.S. PATENT DOCUMENTS

| | | | |
|---|---|---|---|
| 2,402,183 | 6/1946 | Rowe et al. | 91/18 |
| 2,964,272 | 12/1960 | Olson | 248/19 |
| 3,411,479 | 11/1968 | Hutchinson | 118/7 |
| 3,526,535 | 9/1970 | Plumat | 117/120 |
| 3,908,044 | 9/1975 | Gunning | 118/404 |
| 4,267,215 | 5/1981 | Riggs | 118/246 |

*Primary Examiner*—Shrive P. Beck

*Attorney, Agent, or Firm*—John J. Kelleher

[57] ABSTRACT

Method and apparatus for limiting unwanted vibration-induced variations in coating thickness of coating materials deposited on a moving web by an extrusion-type coating applicator employs a vibration generating electro-mechanical transducer coupled to the applicator that produces mechanical vibrations having an amplitude and frequency that produce a reduction in the magnitude of the vibrations causing the unwanted web coating thickness variations.

13 Claims, 5 Drawing Figures

COATING-BEAD STABILIZATION APPARATUS

BACKGROUND OF THE INVENTION

The present invention relates to a continuous flow web coating method and apparatus, in general, and to such method and apparatus for controlling vibration-produced variations in web coating thickness where the coating is applied by continuous flow web coating apparatus, in particular.

There are many well-known methods of machine coating surfaces. These methods include spray coating, coating by transfer of the liquid directly to the surface to be coated by means of an applicator such as a brush or a roller, dip coating and methods wherein the surface to be coated is moved past a slot-like orifice through which the coating fluid is dispensed in the form of a continuous stream or flow.

The known coating methods in the continuous flow coating field include bead-coating and extrusion coating. In head-coating, a head of the coating material is established between a dispenser orifice and the surface to be coated and said bead is maintained by surface tension. Material is continuously withdrawn from the bead by the surface to be coated as it moves past the said dispenser orifice and the coating bead is continuously replenished from the coating material dispenser. By contrast, in extrusion coating, the coating material is forced through a coating applicator orifice, having a particular size and shape, and then onto the surface to be coated as said surface moves past the coating applicator in relatively close proximity thereto. The present invention applies to both such continuous flow coating methods.

In web coating processes wherein coating fluids flowing from a coating applicator are continuously deposited on a moving web spaced an optimum distance from a surface of the web (also referred to as the coating gap) variations in web coating thickness can result for any number of different reasons. Significant variations in web coating thickness can have an adverse effect on coated web properties. After extensive consideration and investigation, it has been determined that one of the many reasons for variations in web coating thickness is low-amplitude, low-frequency vibrations that are coupled to the coating fluid from various components of the coating apparatus. These investigations revealed that vibration of the coating fluid between the coating applicator and the adjacent moving web on which the coating fluid is deposited produces unwanted variations in web coating thickness.

Vibration of the coating fluid or bead (i.e., the coating fluid in the coating gap) can be kept within acceptable vibration levels by maintaining an extremely small coating gap such as an applicator-to-web coating gap of 2.0 mils. However, having a coating gap of this size produces additional web coating problems. One such problem is that of maintaining a uniform gap or applicator-to-web spacing across the entire width of the web to be coated, a web width that is normally in the vicinity of sixty inches. Gap variations across such a web may produce unacceptable variations in web coating thickness. Larger gaps of, for example, 5–10 mils would be significantly less difficult to maintain if such larger gaps could be employed. Another problem associated with small coating gaps is the necessity of periodically increasing gap size in order to enable relatively thick web-to-web splices to pass through a coating gap that would not otherwise permit such passage. This periodic gap size changing exercise raises web coating production costs in that web coating cannot be resumed until the proper gap spacing is re-established after the spliced web ends have passed through the temporarily enlarged coating gap. A further problem is the defects that are produced in a coating by small foreigh particles that will on occasion become lodged in a 2.0 mil coating gap.

A primary object of the present invention is to reduce vibration-induced variations in web coating thickness.

Another object of the present invention is to provide electromechanical vibration-generating apparatus whose vibrations can be coupled to the coating fluid in the coating gap of continuous flow coating apparatus and whose magnitude and frequency can be adjusted to reduce coating fluid vibrations.

A further object of the present invention is to provide continuous flow coating apparatus having a relatively large coating applicator-to-moving web coating gap.

Other objects, features and advantages of the present invention will be readily apparent from the following detailed description of a preferred embodiment thereof taken in conjunction with the accompanying drawings.

SUMMARY OF THE INVENTION

According to the present invention, a method and apparatus is disclosed for controlling unwanted vibration-induced variations in the thickness of coating materials deposited on a moving web by continuous flow coating apparatus. The method and apparatus employs variable mechanical vibration-generating means coupled to the coating applicator whose vibration magnitude and frequency are adjusted to reduce or neutralize coating fluid vibrations causing said coating thickness variations. After the coating fluid vibrations have been so controlled by said variation generating means, the applicator-to-web coating gap can be manually increased to the largest gap dimension that does not produce a reduction in the cross-sectional area of the coating material passing between said applicator and said moving web.

DESCRIPTION OF THE PREFERRED EMBODIMENTS

Figure 1:
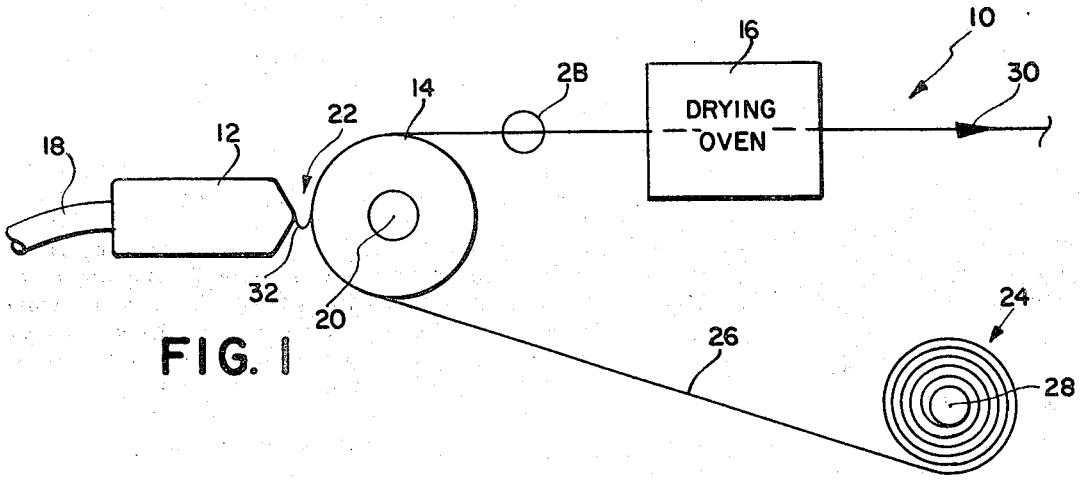
FIG. 1 is an elevational view of a schematic diagram of extrusion-type web coating apparatus constructed in accordance with the prior art.

In the drawings, FIG. 1 illustrates typical extrusion-type web coating apparatus, in schematic, that is in present use in portions of the web coating industry. In FIG. 1, web coating apparatus 10 includes extrusion-type coating applicator 12, rotatably mounted cylindrical backing roller 14 mounted in a spaced relation with respect to said applicator 12 and drying oven 16 through which the coated web is passed immediately after it has been coated in order to reduce web-coating drying time.

Applicator 12, adjustably mounted in a fixed position, is connected to a conventional reservoir of pressurized coating material or fluid (not shown) through conduit 18. Applicator 12 has an elongated orifice or slot therein through which coating material is extruded for subsequent web coating purposes. Backing roller 14 is mounted for rotation about fixed rotational axis 20 such that coating gap 22 is formed between the outer cylindrical surface of said backing roller 14 and extrusion-type applicator 12.

Roll 24 of polyester based sheet-material or web 26 is mouted for rotation on support mandrel 28. Web 26 is moved over backing roller 14, through coating gap 22 and drying oven 16 in direction 30 at a predetermined rate of speed by suitable drive means (not shown) coupled to said web 26. As web 26 moves through coating gap 22 between applicator 12 and backing roller 14, coating fluid 32 extruded from a precisely shaped slot (not shown) in applicator 12 at a predetermined volume flow rate is deposited on a surface of moving web 26. The coated web is then moved through oven 16 to reduce coating drying time.

After extensive consideration and investigation, it was determined that coating fluid 32 vibrates at a relatively low frequency and amplitude as it moves through gap 22 between applicator 12 and moving web 26. Coating fluid 32 vibration, which for one particular photographic coating emulsion vibrated at approximately 100 Hz, is undetectable by the unaided human eye. Coating fluid vibrations appear to have several causes that include coating machine produced vibrations that are coupled to the coating fluid through coating applicator 12 as well as through the coating fluid that is pressurized in order to extrude the coating fluid through applicator 12.

Figure 2B:
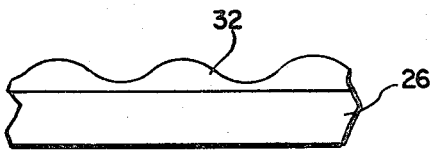
FIG. 2B is an enlargement of detail 2B in drawing FIG. 1.
Figure 2A:
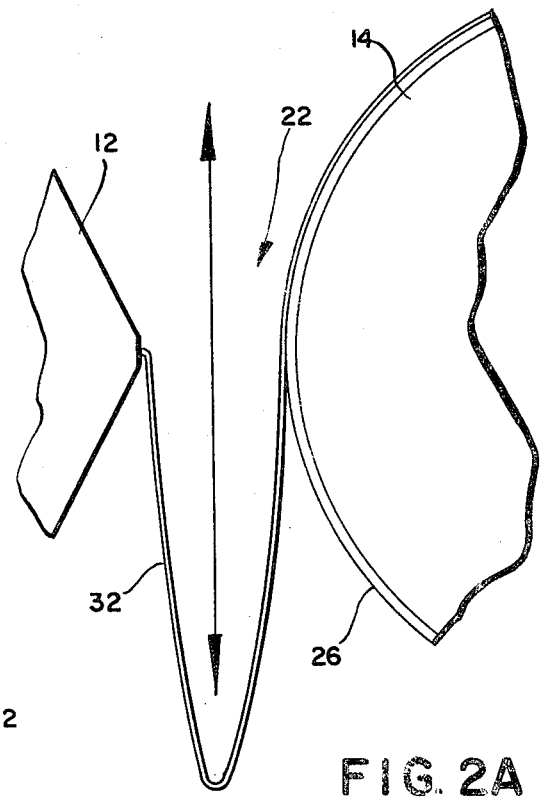
FIG. 2A is an enlarged detail of the coating bead and portions of the web and coating applicator adjacent thereto as shown in drawing FIG. 1.

As schematically shown in drawing FIG. 2A, which is an enlarged detail of that portion of coating fluid 32 within coating gap 22 and portions of applicator 12, web 26 and backing roller 14 adjacent or opposite thereto, coating fluid 32 is shown oscillating or vibrating within coating gap 22. The extent of coating fluid vibrations within said coating gap 22 has been greatly exaggerated for reasons of emphasis only. As shown in drawing FIG. 2B, which is an enlargement of detail 2B in FIG. 1, the effect of coating fluid vibrations in coating gap 22 is the production of unwanted variations in the thickness of coating 32 on web 26. Significant coating thickness variations can produce a coated web that is unsuitable for its intended purpose. As explained above, the vibrations of coating fluid 32 within gap 22 can be held to within acceptable limits by maintaining a relatively small coating gap. However, as noted above, small coating gaps generate additional problems that may have serious negative effects on web coating quality and/or coated web manufacturing costs.

The method and apparatus of the present invention reduces or neutralizes vibrations of the coating fluid to thereby reduce variations in coating thickness and also enables relatively large gaps to be maintained between the coating applicator and the surface of the web adjacent the coating applicator because of such reduction or neutralization. Coating fluid vibration control is accomplished in the following manner. The magnitude and frequency of the coating applicator must initially be determined under actual coating conditions by employing conventional vibration measurement apparatus to measure applicator vibrations while coating fluid is being deposited on the moving web. Once applicator vibration magnitude and frequency have been determined, mechanical vibrations having the same magnitude and frequency, but 180° out of phase from that of the vibrating applicator are generated and coupled to said applicator for the purpose of reducing or neutralizing coating applicator vibration. The apparatus for generating the coating applicator vibrations is shown in drawing FIGS. 3 and 4.

Figure 3:
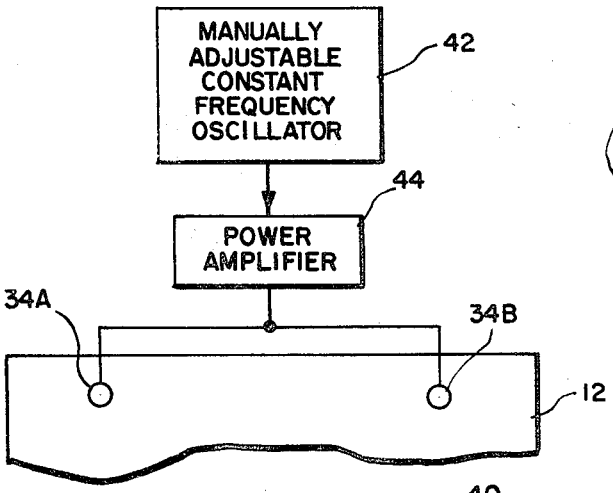
FIG. 3 is a schematic diagram of the vibration controlling apparatus of the present invention showing a pair of mechanical vibrators mounted on an extrusion-type coating applicator.
Figure 4:
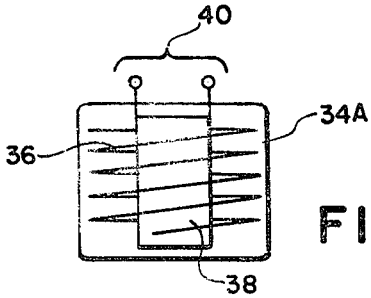
FIG. 4 is an enlarged detail of one of the vibration generating mechanical vibrators shown in drawing FIG. 3.

In FIG. 3, a pair of electromechanical vibrators 34A and 34B are attached to an upper surface of extrusion-type applicator 12 in a fixed relation. An enlarged detail of electro-mechanical vibrator 34A is shown in drawing FIG. 4. In FIG. 4, electromechanical vibrator 34A includes winding 36 that surrounds movable core 38. When an AC voltage is applied to terminals 40 of electromechanical vibrator 34A, movable core 38 of said vibrator 34A will vibrate at a frequency and magnitude that is related to the frequency and magnitude of the applied AC voltage. The necessary vibration-producing AC voltage is applied to vibrators 34A and 34B in the following manner. The output of manually adjustable constant frequency oscillator 42 is connected to the inputs of parallel connected electromechanical vibrators 34A and 34B through power amplifier 44. The amplitude and frequency (including phase) of the output of constant frequency oscillator 42 is manually adjusted until the magnitude and frequency of electromechanical vibrators 34A and 34B are equal to the previously measured magnitude and frequency of mechanically vibrating applicator 12, and 180° out of phase with said applicator 12 vibrations. As a practical matter, the desired vibrations are obtained from parallel connected spaced-apart vibrators 34A and 34B by manually adjusting the output of oscillator 42 to the approximate amplitude and frequency by observing conventional output frequency and amplitude meters (not shown) located on constant frequency oscillator 42. Once the approximate oscillator 42 output frequency has been manually set, applicator 12 vibration amplitude is once again monitored while coating material 42 is being deposited on moving web 26. The output frequency and magnitude of oscillator 42 is once again adjusted until the sensed vibration of applicator 12 is reduced to a minimum. Once this minimum vibration condition is achieved, coating gap 22 can be increased from the minimum gap position that is initially established before vibration suppressing vibrations are applied to applicator 12 by vibrators 34A and 34B, to a larger dimensioned gap 22 with its above-enumerated advantages. The maximum gap 22 spacing that can be obtained while vibrators 34A and 34B are suppressing applicator 12 vibrations is determined by visually observing the cross-sectional area of coating fluid 32 in gap 22 as the size of gap 22 is being manually increased. Maximum gap 22 spacing occurs just before the applicator 12-to-web 26 spacing where a reduction in the cross-sectional area of coating fluid 32 occurs as a result of the size of gap 22 being increased beyond its largest acceptable gap dimension.

By employing the vibration suppressing apparatus of the present invention, applicator-to-web spacing can be made several times larger than the relatively small applicator-to-web gaps that have heretofore been employed. Coating gap size has a direct effect on web coating thickness and therefore coating gap spacing is normally maintained to within ±5% of its initial gap setting in order to be reasonably certain that coating thickness variations are kept within acceptable limits. If coating gap size can be made several times larger than the minimum coating gap dimension that has heretofore been employed for the control of coating thickness variations, such as increasing a minimum 2.0 mils size gap to a larger 10.0 mil size gap, it would be substantially less difficult to maintain a ±5% gap-variation tolerance on a 10.0 mil size gap than it would be to maintain the same percentage tolerance on a 2.0 mil size gap with its smaller initial gap setting. In addition, with larger coating gaps, there is less likelihood that coating surface damaging foreign particles will become lodged between the coating applicator and the moving web surface and there would be no need to temporarily increase the applicator-to-web coating gap to permit the passage of relatively thick web-to-web splices therethrough.

In the preferred embodiment of the present invention, a pair of electromechanical vibrators have been employed for coating fluid vibration controlling purposes. However, depending upon the type of coating apparatus/material involved, additional vibration generators may be employed along the coating applicator in some coating applications in order to further reduce coating thickness variations.

It will be apparent to those skilled in the art from the foregoing description of my invention that various improvements and modifications can be made in it without departing from its true scope. The embodiments described herein are merely illustrative and should not be viewed as the only embodiments that might encompass my invention.

What is claimed is:

1. Apparatus for improving thickness uniformity of liquid coating material deposited on a moving web by a coating applicator spaced from a surface of said moving web wherein said coating material has objectionable coating thickness variation producing vibrations naturally occurring in at least that portion of the coating liquid moving from said applicator to said web, said apparatus comprising vibration generating means coupled to said coating applicator for generating a source of vibrations in offsetting relation to said objectionable vibrations so as to reduce said vibrations in that portion of the coating liquid moving from said coating applicator to said moving web to thereby improve web coating thickness uniformity.

2. The apparatus of claim 1, wherein said coating applicator is of the extrusion type.

3. The apparatus of claim 1 wherein said vibration generating means is approximately the same frequency as that of said objectional vibration, but offset in phase with respect thereto.

4. The apparatus of claim 1, wherein said vibration generating means includes an electromechanical vibrator.

5. The apparatus of claim 4, wherein said vibration generating means includes a plurality of electromechanical vibrators.

6. The apparatus of claim 1, wherein said vibration generating means produces mechanical vibrations that are approximately equal in magnitude and frequency to the vibrations of said coating fluid and generally 180° out of phase with respect to said objectional vibrations.

7. Improved apparatus for depositing a uniform thickness coating on a moving web, comprising:

a rotatably mounted web-supporting backing roller;

a coating applicator coupled to a source of coating fluid, said applicator being mounted in a spaced relation with respect to said backing roller;

drive means coupled to the web for moving said web through the said space between said applicator and said backing roller; and vibration generating means coupled to said applicator for generating a source of mechanical vibrations in offsetting relation to objectionable vibrations naturally occurring in the coating fluid moving from said applicator to a surface of said moving web.

8. A method of controlling objectionable vibrations occurring in coating material flowing from a coating applicator to the surface of a moving web spaced from said applicator, said method comprising the steps of:

sensing the amplitude and frequency of any mechanical vibrations of said coating applicator;

applying a source of mechanical vibrations to said applicator; and adjusting the amplitude, frequency or phase characteristics of said source of mechanical vibration while monitoring the vibration amplitude of said coating applicator to reduce said applicator vibrations.

9. The method of claim 8, further comprising the additional steps of increasing applicator-to-web spacing from a minimum size to any desired larger size that does not produce a visually observed decrease in cross-sectional area of coating material moving between said applicator and said moving web surface.

10. A method of coating a web surface with coating material, said method comprising the steps of:

depositing said coating material on said web surface by means of an applicator system having naturally occurring, objectionable vibrations detrimental to the uniformity of the deposited coating material; and driving said applicator system with applied vibrations which are in offsetting relation to said objectional vibrations so as to reduce the detrimental effects thereof.

11. The method of claim 10 including monitoring vibration of at least a portion of said applicator system during said depositing and adjusting the characteristics of said applied vibrations to reduce the overall vibration of at least said portion of said system.

12. The method of claim 11 wherein the frequency of said applied vibration is adjusted for matching relationship with that of said naturally occurring vibration and the phase of said applied vibration is adjusted to an offsetting relationship with that of said naturally occurring vibration.

13. The method of claim 11 wherein said system includes an applicator spaced from said web surface, and said driving step includes driving said applicator with said applied vibration.

* * * * *